US007579543B2

(12) United States Patent
Haruyama et al.

(10) Patent No.: US 7,579,543 B2
(45) Date of Patent: Aug. 25, 2009

(54) ELECTRONIC MUSICAL APPARATUS AND LYRICS DISPLAYING APPARATUS

(75) Inventors: Kazuo Haruyama, Shizuoka-ken (JP); Shinichi Ito, Shizuoka-ken (JP); Takashi Ikeda, Shizuoka-ken (JP); Tadahiko Ikeya, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 689 days.

(21) Appl. No.: 10/996,404

(22) Filed: Nov. 23, 2004

(65) Prior Publication Data

US 2005/0109195 A1 May 26, 2005

(30) Foreign Application Priority Data

Nov. 26, 2003 (JP) ..... 2003-395925

(51) Int. Cl.
*G10H 1/00* (2006.01)

(52) U.S. Cl. ..... 84/601; 84/609; 84/615

(58) Field of Classification Search ..... 84/601, 84/609, 615, 622; 434/307 A
See application file for complete search history.

(56) References Cited

U.S. PATENT DOCUMENTS 5,506,370 A 4/1996 Nakai et al.
5,561,849 A * 10/1996 Mankovitz ..... 455/45
5,808,223 A 9/1998 Kurakake et al.
6,538,188 B2 3/2003 Kondo
2003/0051595 A1* 3/2003 Hasegawa ..... 84/637

FOREIGN PATENT DOCUMENTS

| | | |
|---|---|---|
| JP | 07-084587 | 3/1995 |
| JP | 10-254467 | 9/1998 |
| JP | 3218946 | 8/2001 |
| JP | 2003-015668 | 1/2003 |
| JP | 2003-323186 | 11/2003 |
| JP | 2003-330473 | 11/2003 |

OTHER PUBLICATIONS

Notice of Reasons of Rejection (English translation). Japanese Patent Office application 2003-395925. Oct. 28, 2008.*
Decisions of Rejection (English translation). Japanese Patent Office application 2003-395925. Feb. 3, 2009.*

* cited by examiner

*Primary Examiner*—David S. Warren
(74) *Attorney, Agent, or Firm*—Harness, Dickey & Pierce, PLC

(57) ABSTRACT

An electronic music apparatus comprises an extractor that extracts lyrics data from music data for reproduction of music and comprising the lyrics data representing lyrics of the music, a transmitter that transmits the extracted lyrics data to an external device, a reproducer that reproduces the music data, and a outputting device that outputs synchronization information for controlling display of the lyrics by the external device based on the lyrics data to the external device during reproduction of the music data in accordance with a progress of the reproduction of the music data.

17 Claims, 5 Drawing Sheets

ELECTRONIC MUSICAL APPARATUS AND LYRICS DISPLAYING APPARATUS

CROSS REFERENCE TO RELATED APPLICATION

This application is based on Japanese Patent Application 2003-395925, filed on Nov. 26, 2003, the entire contents of which are incorporated herein by reference.

BACKGROUND OF THE INVENTION

A) Field of the Invention

This invention relates to an electronic musical apparatus, and more in detail, an electronic musical apparatus that can display lyrics and a chord name on other electronic musical apparatus.

B) Description of the Related Art

In an electronic musical apparatus that has an automatic musical performing function such as an electronic musical instrument, when music data including lyrics data is reproduced, it is well-known that an external displaying apparatus displays lyrics via a video-out device (image data output circuit), for example refer to JP-A 2002-258838.

In the above-described prior art, lyrics corresponding to music data are output to an external apparatus as image data, and lyrics can be displayed on a separated displaying device and a displaying device that has a large screen.

In the prior art, however, image data (image signals) for displaying lyrics is generated based on lyrics data and image data is transmitted to an external apparatus via a video-out device, this kind of apparatus is expensive since the video-out device is generally expensive.

SUMMARY OF THE INVENTION

It is an object of the present invention to provide an electronic musical apparatus that can display lyrics on an external lyrics displaying apparatus (an electronic musical apparatus) without equipping an expensive video-out device.

It is another object of the present invention to provide an electronic musical apparatus that is capable of displaying lyrics information output from other electronic musical apparatus in synchronization with music data reproduced by the other electronic musical apparatus According to one aspect of the present invention, there is provided an electronic music apparatus, comprising: an extractor that extracts lyrics data from music data for reproduction of music and comprising the lyrics data representing lyrics of the music; a transmitter that transmits the extracted lyrics data to an external device; a reproducer that reproduces the music data; and a outputting device that outputs synchronization information for controlling display of the lyrics by the external device based on the lyrics data to the external device during reproduction of the music data in accordance with a progress of the reproduction of the music data.

According to another aspect of the present invention, there is provided a lyrics displaying apparatus, comprising: a first receiver that receives lyrics data representing lyrics of music from an external device; a memory that temporarily stores the received lyrics data; a display that displays the lyrics in accordance with the received lyrics data; a second receiver that receives synchronization information from the external device; and a controller that controls display of the lyrics in accordance with the received synchronization information.

According to still another aspect of the present invention, there is provided an electronic music apparatus, comprising: an extractor that extracts text data from music data for reproduction of music and comprising the text data; a transmitter that transmits the extracted text data to an external device; a reproducer that reproduces the music data; and a outputting device that outputs synchronization information for controlling display of the text by the external device based on the text data to the external device during reproduction of the music data in accordance with a progress of the reproduction of the music data.

According to the present invention, lyrics can be displayed on an external lyrics displaying apparatus (an electronic musical apparatus) without equipping an expensive video-out device.

Moreover, according to the present invention, lyrics information that is output from other electronic musical apparatus can be displayed establishing synchronization to music data that is reproduced the other musical apparatus.

DETAILED DESCRIPTION OF THE PREFERRED EMBODIMENTS

Figure 1:
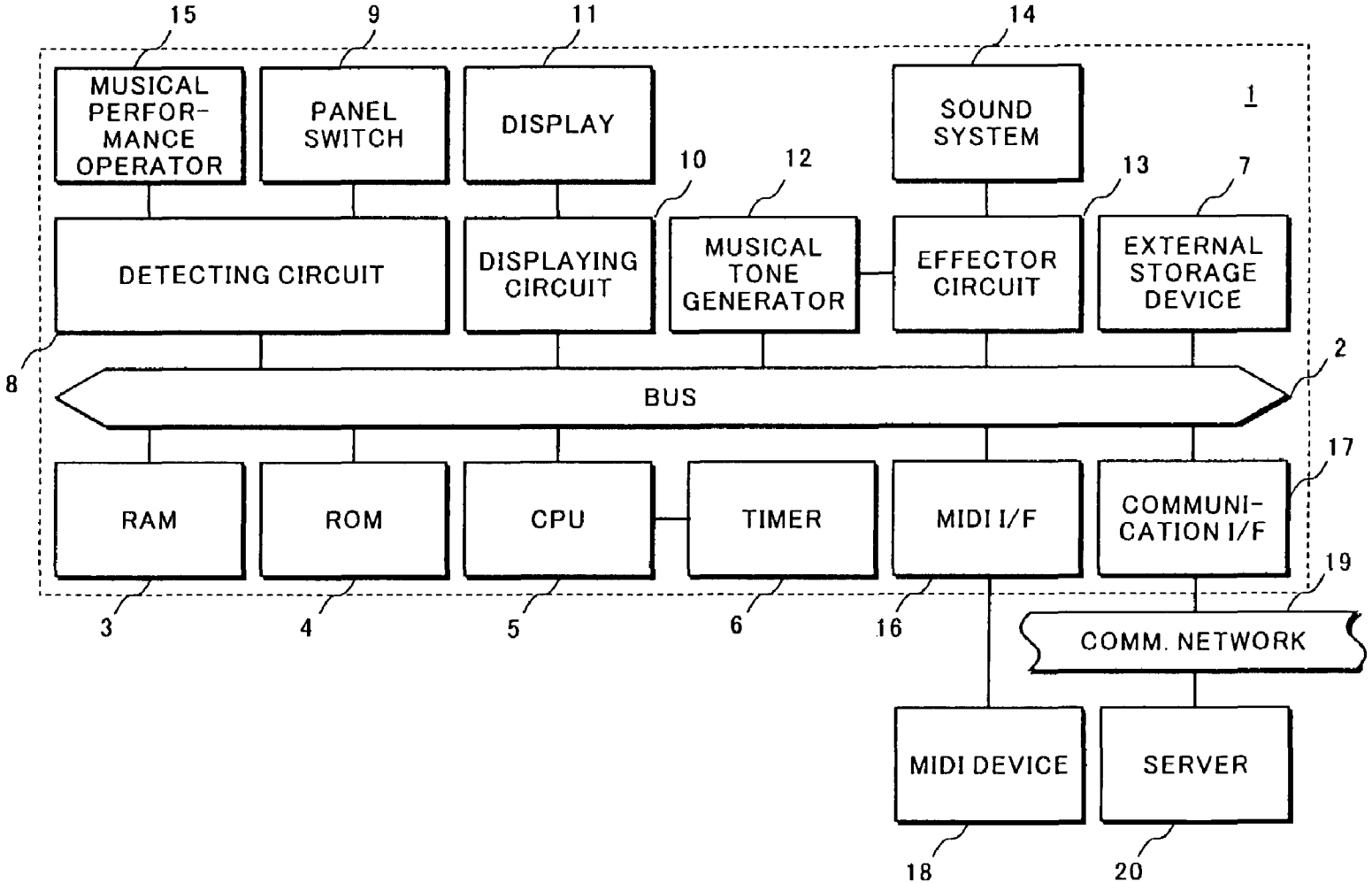
FIG. 1 is a block diagram showing an example of a hardware structure of an electronic musical apparatus consisting an electronic musical instrument 1A and a computer 1P according to an embodiment of the present invention.

FIG. 1 is a block diagram showing an example of a hardware structure of an electronic musical apparatus consisting an electronic musical instrument 1A and a computer 1P according to an embodiment of the present invention.

A RAM 3, a ROM 4, a CPU 5, an external storing device 7, a detector circuit 8, a display circuit 10, a musical tone generator 12, an effecter circuit 13, a MIDI interface 16, a communication interface 17 are connected to a bus 2 in the electronic musical apparatus 1.

A user can make various set up by using a plurality of panel switches 9 connected to the detector circuit 8. The panel switches 9 may be any device which can output a signal corresponding to input by a user, for example, one or a combination of a rotary encoder, a switch, a mouse, an alphanumeric keyboard, a joy-stick, a jog-shuttle, etc. can be used as the panel switches 9.

Moreover, the panel switch 9 may be a software switch or the like displayed on a display 11 that is operated by using other switch such as a mouse.

The display circuit 10 is connected to the display 11, and various types of information can be displayed on the display 11.

The external storage device 7 includes an interface for the external storage device and is connected to the bus 2 via the interface. The external storage device is, for example, a floppy (a trademark) disk drive (FDD), a hard disk drive (HDD), a magneto optical disk (MO) drive, a CD-ROM (a compact disk read only memory) drive, a DVD (Digital Versatile Disk) drive, a semiconductor memory, etc.

Various types of parameters, various types of data, a program for realizing the embodiment of the present invention, music data, etc. can be stored in the external storage device 7. Moreover, in the embodiment of the present invention, at least one music data PD (FIG. 3) including lyrics information is stored in advance.

The RAM 3 provides a working area for the CPU 5 and stores a flag, a register or a buffer, and various types of parameters. Various types of parameters and control program, or programs for realizing the embodiment of the present invention can be stored in the ROM 4. The CPU 5 executes calculations or controls in accordance with a control program stored in the ROM 4 or the external storage device 7.

A timer 6 is connected to the CPU 5 and provides a basic clock signal, an interrupt process timing, etc. to the CPU.

The musical tone generator 12 generates a musical tone signal corresponding to a performance signal such as a MIDI signal or the like provided by MIDI information MD recorded in the external storage device 7, a MIDI device 18 connected to the MIDI interface 16, and the musical tone signal is provided to a sound system 14 via the effecter circuit 13.

A type of the musical tone generator may be anything such as a wave-memory type, FM type, a physical model type, a high frequency wave synthesizing type, a Formant synchronization type, VCO+VCF+VCA analogue synchronization type, an analogue simulation type, etc. Moreover, the musical tone generator 12 may be composed by using a dedicated hardware or by using a DSP and a micro-program, or may be composed of the CPU and a software program. Further, it may be a combination of those. Moreover, a plurality of reproduction channels may be formed by using one circuit by the time division, or one reproduction channel may be formed with one circuit.

The effecter circuit 13 gives various types of effects on the digital musical tone signal provided by the musical tone generator 12. The sound system 14 includes a D/A converter and a loudspeaker and converts the provided digital musical tone signal to an analogue musical tone signal for reproduction of a musical tone.

A musical performance switch 15 is connected to the detector circuit 8 and provides a musical performance signal in accordance with a user's instruction (a musical performance). In the embodiment of the present invention, a musical keyboard for a musical performance is used as the performance switch 15. The performance switch 15 may be any types of switches that can at least output a musical performance signal such as a MIDI signal.

The MIDI interface (MIDI I/F) 16 can be connected to a electronic musical instrument, other musical instrument, an audio device, a computer, etc., and at least can receive and transmit a MIDI signal. The MIDI interface 16 is not limited to a dedicated MIDI interface, and may be formed by using a widely used interface such as RS-232C, USB (universal serial bus), IEEE1394, etc. In this case, data other than MIDI message may be transmitted at the same time. Moreover, in the embodiment of the present invention, the electronic musical instrument 1A and the computer 1P are connected via this MIDI interfaces.

The MIDI device 18 is an audio device, a musical instrument, etc. connected to the MIDI interface 16. Type of the MIDI device 18 is not limited to a keyboard type musical instrument, it may be a stringed instrument type, a wind instrument type, a percussion instrument type, etc. Also, it is not limited to the apparatus in which the musical tone generator and the automatic musical performance device are built in one apparatus, and they may be separate devices connecting by using communication means such as MIDI or various types of communication networks. A user can input a performance signal by performing (operating) this MIDI device 18.

Moreover, the MIDI device 18 can be used as a switch for inputting various types of data other than musical performance information and various types of settings.

The communication interface 17 can be connected to the LAN (local area network), the Internet and a communication network 19 such as telephone line, etc. and is connected to a server computer 20 via the communication network 19. Then the communication interface 17 can download a control program, programs for realizing the embodiment of the present invention and performance information from the server computer 20 to the external storage device 7 such as the HDD, the RAM 4, etc.

Moreover, the communication interface 17 and the communication network 19 are not limited to be wired but also may be wireless. Moreover, the apparatus may be equipped with both of them.

Figure 2:
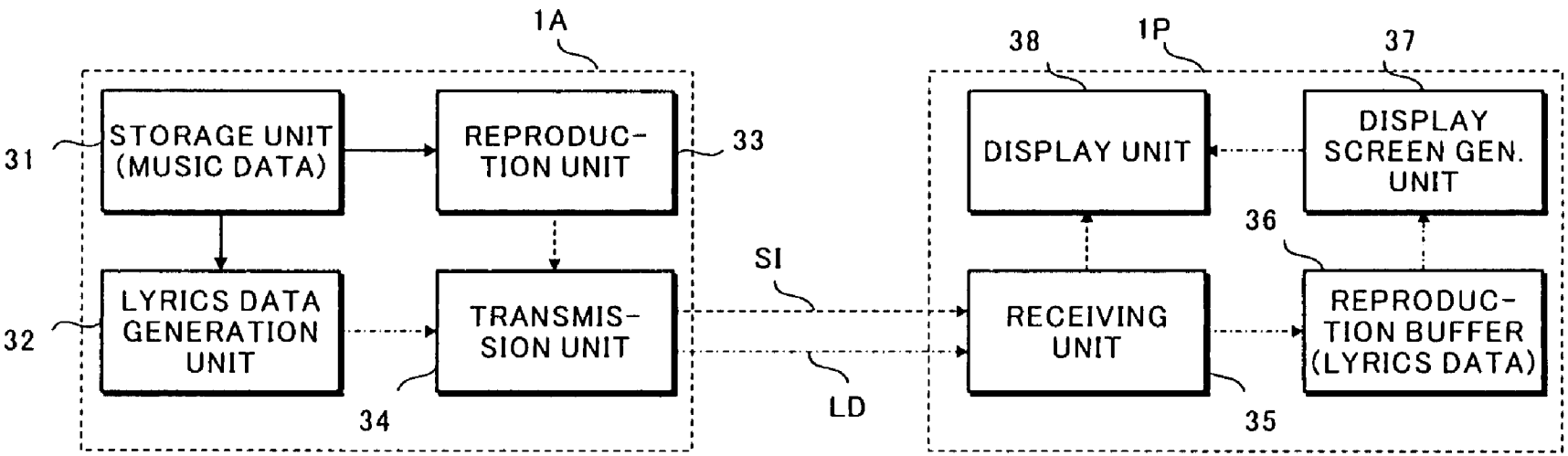
FIG. 2 is a block diagram showing a function of a lyrics displaying system consisted of the electronic musical instrument 1A and the computer 1P according to the embodiment of the present invention.

FIG. 2 is a block diagram showing a function of a lyrics displaying system 100 composed by the electronic musical instrument 1A and the computer 1P according to the embodiment of the present invention. In the diagram, a solid line represents music data PD, a chain line represents lyrics data LD, and a broken line represents synchronization information SI.

The electronic musical instrument 1A includes at least a storage unit 31, a lyrics data generation unit 32, a reproduction unit 33 and a transmission unit 34. The computer (PC) 1P includes at least a receiving unit 35, a reproduction buffer 36, a display screen generation unit 37 and a display unit 38.

Music data PD including lyrics information (for example, lyrics event LE indicated in FIG. 3) is stored in the storage unit 31. The music data PD read from the storage unit 31 by selection of the user is transmitted to the generation unit 32, and the generation unit 32 extracts the lyrics information from the received music data to generate lyrics data LD. The generated lyrics data is transmitted to the transmission unit 34.

The music data PD read from the storage unit 31 is transmitted to the generation unit 32 and the reproduction unit 33. In the reproduction unit 33, the music data PD is reproduced, and synchronization information SI is generated corresponding to progress in the reproduction of the music data PD and thereafter transmitted to the transmission unit 34.

The transmission unit 34 transmits the lyrics data LD received from the generation unit 32 to the receiving unit 35 in the computer 1P, for example, via the communication interface such as the MIDI interface. Also, the synchronization information SI received from the reproduction unit 33 is transmitted to the receiving unit 35. Moreover, transmissions of the lyrics data LD and the synchronization information SI are executed based on the MIDI Standards.

The receiving unit 35 transmits the lyrics data LD received from the transmission unit 34 to the reproduction buffer 36 and receives the synchronization information SI transmitted from the transmission unit 34 in sequence and transmits it to the display unit 38. The reproduction buffer 36 stores the lyrics data LD temporally. The display screen generation unit 37 generates a lyrics displaying screen for one page (a range that can be displayed at a time) based on the lyrics data LD stored in the reproduction buffer 36 and transmits to the display unit 38. The display unit 38 displays the lyrics displaying screen in accordance with the synchronization information SI transmitted from the receiving unit 35.

Figure 4:
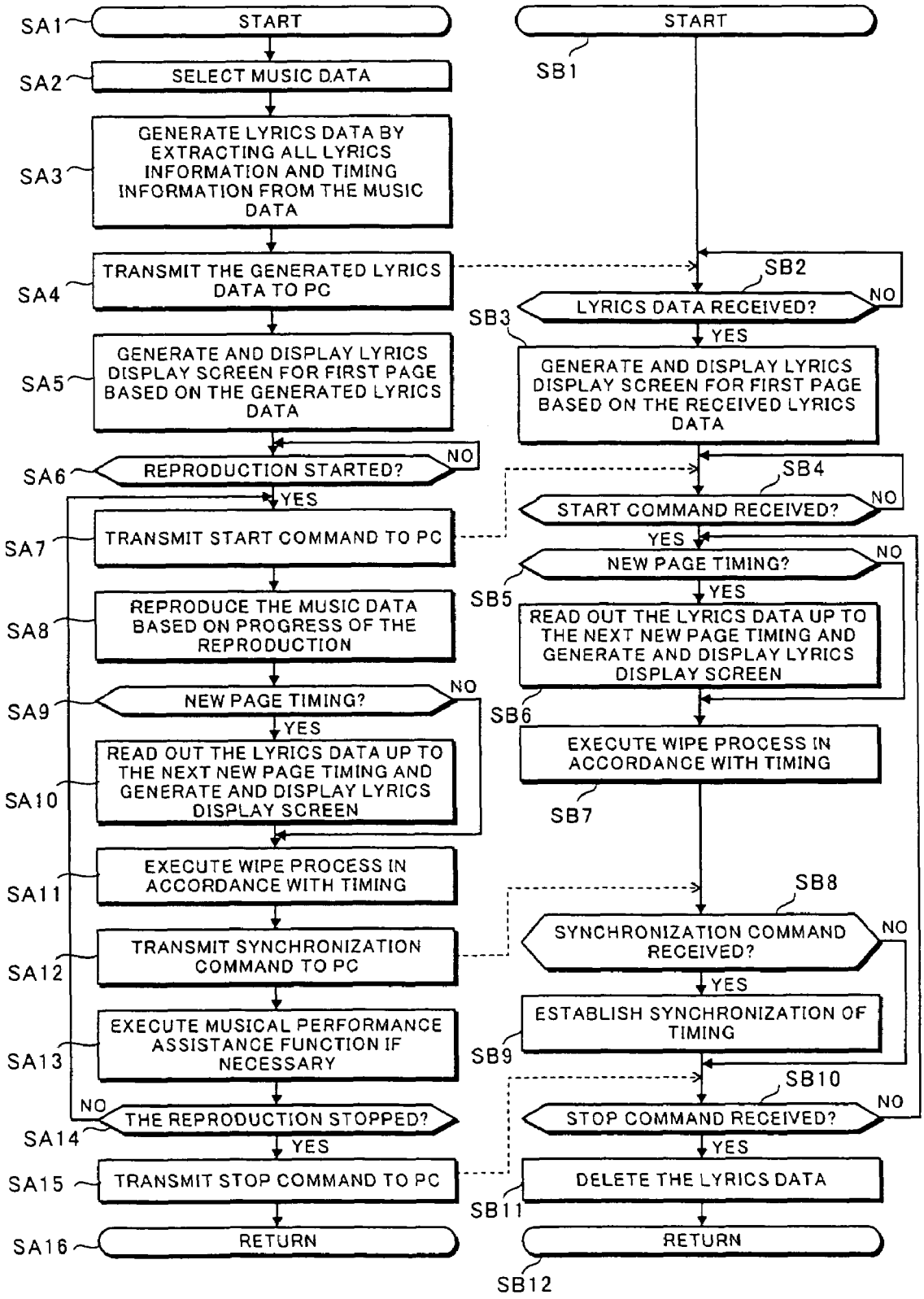
FIG. 4 shows flow charts showing examples of processes executed by the electronic musical instrument 1A and the computer 1P at a time that all lyrics data LD is transmitted in advance at once.
Figure 5:
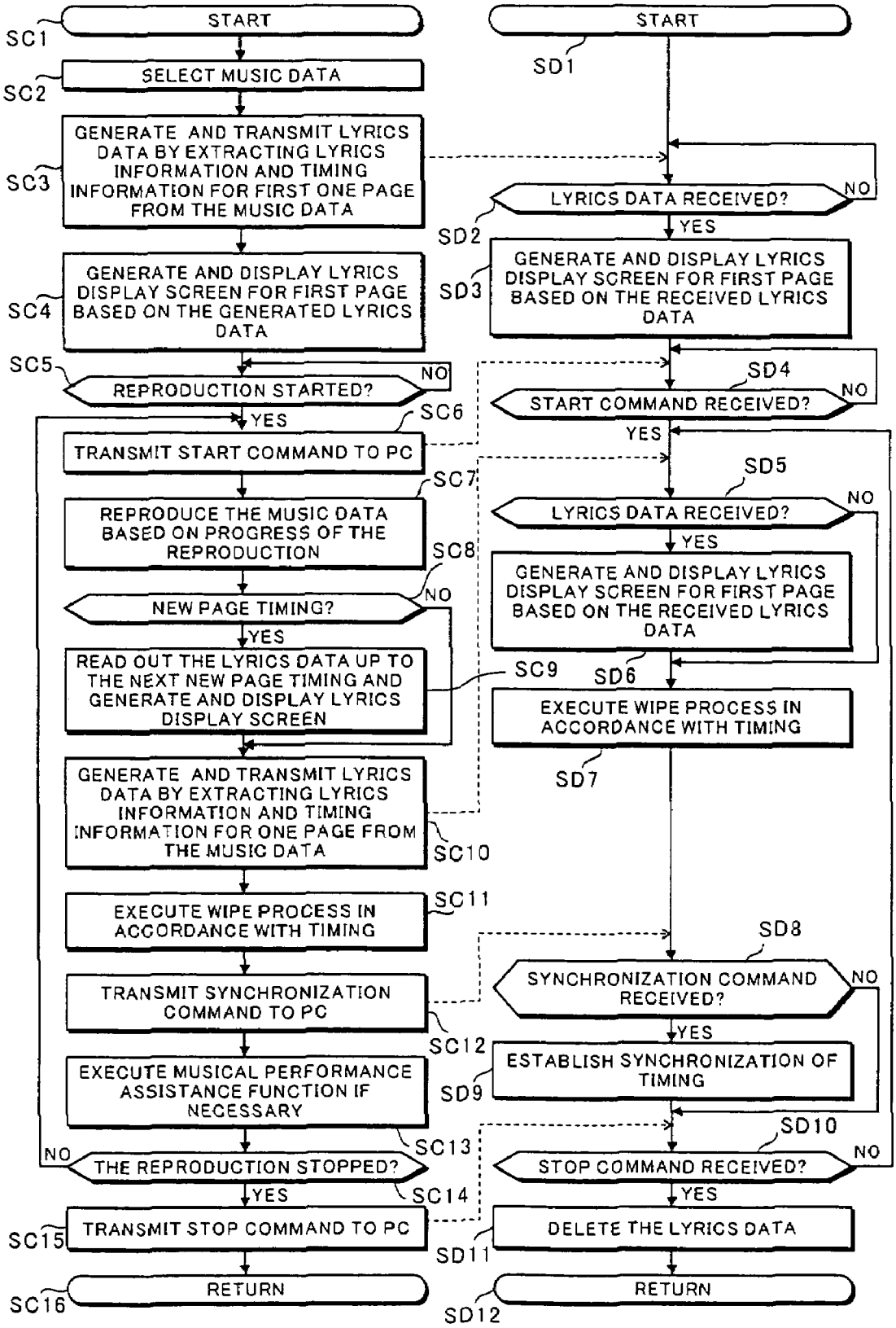
FIG. 5 shows flow charts showing examples of processes executed by the electronic musical instrument 1A and the computer 1P at a time that lyrics data LD for every page is generated and transmitted.

Moreover, the generation and the transmission of the lyrics data LD can be executed to the music data as a whole at a time. A processing example at a time of transmitting all the lyrics data LD at a time is shown in FIG. 4, and an example of the generation and the transmission of the lyrics data LD for one page is shown in FIG. 5.

Figure 3:
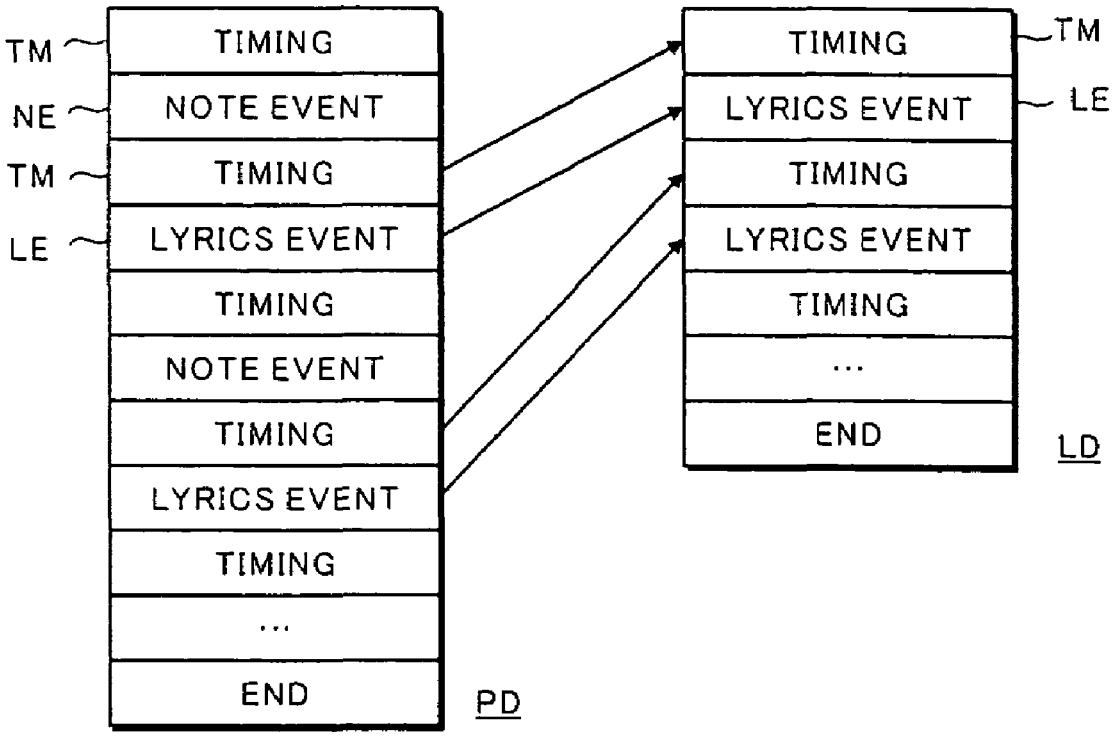
FIG. 3 is a schematic view showing music data PD and lyrics data LD according to the embodiment of the present invention.

FIG. 3 is a schematic view showing the music data PD and the lyrics data LD according to the embodiment of the present invention. In the diagram, the original music data PD is shown on the left side, and the lyrics data LD that is generated from the music data is shown on the right side.

The music data PD is consisted of at least timing data TM that represents a reproduction timing with a musical measure, beat and time, a note-on event NE that is event data representing event by each timing and a lyrics event LE. Also, the music data PD can be composed of a plurality of musical parts.

The timing data TM is data that represents time for processing various types of events represented by the event data. A processing time of an event can be represented by an absolute time from the very beginning of a musical performance or by a relative time that is an elapse from the previous event. For example, the timing data TM represents a processing time of the event by a parameter of the number of measures, the number of beats in the measure and time (clock) in the beat.

The event data is data representing contents of various types of events for reproducing a song. The event may be a note event (note data) NE that is a note-on event or a combination of a note-on event and a note-off event and represents a note directly relating to reproduction of a musical tone, a pitch change event (pitch bend event), a tempo change event, a setting event for setting a reproduction style of music such as a tone color change event, a lyrics event LE recording a text line of lyrics, etc.

The lyrics event LE records lyrics to be displayed at the timing with, for example, text data. Lyrics event LE is stored corresponding to a note event NE. That is, one lyrics event LE corresponds one note event NE. Timing represented with timing data TM of the lyrics event LE is the same timing as timing represented by corresponding timing data of the note event NE or timing just before and after the same timing that can be regarded as the same timing.

The lyrics data LD is composed including at least the lyrics event LE extracted from music data PD and the timing data TM representing display (reproduction) timing of the lyrics event LE. The lyrics event LE is composed of text data or the like representing a lyrics text line to be displayed. Moreover, the lyrics event LE includes a carriage return (new line) command and a new page command. Also, the lyrics event LE may include information about a font type, a font size and a display color of a lyrics text line to be displayed.

FIG. 4 shows flow charts showing examples of processes executed by the electronic musical instrument 1A and the computer 1P at a time that all the lyrics data LD is transmitted at once in advance. Step SA1 to Step SA16 represent the process executed by the electronic musical instrument 1A (a transmitting side: an automatic musical performance apparatus). Step SB1 to Step SB12 represent the process executed by the computer 1P (a receiving side: a lyrics display apparatus). Further, the electronic musical instrument and the computer (PC) are mutually connected, for example, via the MIDI interfaces 16 (FIG. 1) with a MIDI cable. Also, data communications between the electronic musical instrument and the computer (PC) in the later-described processes are executed based on the MIDI Standards. Moreover, it is not limited to the MIDI interface 16, and they may be connected each other via a USB interface and the IEEE 1394 interface which can executed data communication by the MIDI Standards.

At Step SA1, a process at the electronic musical instrument side is started. At Step SA2, the music data PD (FIG. 3) corresponding to a song to be reproduced (of which lyrics to be displayed) is selected from, for example, an external storage device 7 (FIG. 1). For example, a list of the music data PD is displayed on the display 11 for selection of the music data PD. The desired music data PD is selected from the list by using the panel switch 9.

At Step SA3, all the lyrics information (for example, the lyrics event LE in FIG. 3) and the timing information (for example, the timing data in FIG. 3) are extracted from the music data PD selected at Step SA2, and the lyrics data LD (FIG. 3) for all pages is generated. Then, at Step SA4, the generated lyrics data LD is transmitted to the computer (PC) 1P by MIDI Standards, for example, a system exclusive message.

At Step SA5, a lyrics displaying screen for the first page, that is, a lyrics displaying screen from the beginning of the music data to the lyrics event including the first new page command and the timing data TM corresponding to the lyrics event in accordance with the lyrics data LD generated at Step SA3, and the generated lyrics displaying screen is displayed on, for example, the display 11 on the electronic musical instrument 1A.

At Step SA6, it is judged whether reproduction of the selected music data PD at Step SA2 is started or not. When the reproduction is started, the process proceeds to Step SA7 as indicated with an arrow "YES" and a start command will be transmitted to the PC. When the reproduction is not started, the process repeats Step SA6 as indicated with an arrow "NO".

At Step SA8, the music data PD is reproduced in accordance with song progress (a progress in the reproduction). The reproduction of the music data PD is based on the note events included in the music data PD, for example, the musical tone data is generated by the musical tone generator 12, and a musical tone will be sounded with the sound system 14 based on the generated musical tone data via the effecter circuit.

At Step SA9, it is judged whether the current timing is a new page timing or not, for example, whether the reproduction of the music data PD corresponding to the lyrics displayed in the previous page is finished or not. If it is the new page timing, the process proceeds to Step SA10 as indicated with an arrow "YES". If it is not the new page timing, the process proceeds to Step SA11 as indicated with an arrow "NO". In the embodiment of the present invention, since the lyrics event LE of the lyrics data LD includes a new page command, judgment whether it is a new page timing or not is executed by detecting the new page command in the lyrics event. Moreover, in a case of using the lyrics data LD not including a new page command, for example, the number of characters to be displayed in a page is set in advance, and timing to be a new page may be determined by the number of characters.

At Step SA10, the lyrics data LD up to the next new page timing (for every page) will be read, and a lyrics displaying screen for the next page is formed to display.

At Step SA11, a wipe process of the lyrics display is executed in accordance with the timing data LD, and the wipe process at this step is at least for displaying the lyrics corresponding to the current position in the music data can be visually recognized by the user. For example, a display style of the lyrics after the current position and of the lyrics before the current position will be different from each other. Moreover, the wipe process of the lyrics is executed by every character or a unit, that is, the lyrics event NE unit, corresponding to one key note (note event NE). Further, a smooth wipe can be applied within one character.

At Step SA12, a synchronization command (the synchronization information SI) is generated in accordance with the progress of the reproduction of the music data PD and transmitted to the PC. The synchronization information SI that is generated and transmitted at this step is based on the MIDI Standards, for example, a MIDI clock or a MIDI time code.

At Step SA13, a musical performance assistant function is executed if necessary. The musical performance assistant function is, for example, a fingering guide, etc.

At Step SA14, it is judged whether the reproduction of the music data PD is stopped (finished) or not. If the reproduction is stopped, the process proceeds to Step SA15 as indicated with an arrow "YES" and a stop command will be transmitted to the PC. Thereafter the process proceeds to Step SA16 to finish the process on the electronic musical instrument side. If the reproduction is continued (in progress), the process returns to Step SA7 to repeat the process after Step SA7.

At Step SB1, the process (a lyrics displaying software program) executed by the computer (PC) is started. At Step SB2, it is judged whether the lyrics data LD for all the pages transmitted from the electronic musical instrument at Step SA4 is received or not. If the lyrics data LD is received, for example, the lyrics data LD is stored in the reproduction buffer 36 (FIG. 2) provided in the RAM 3 (FIG. 1) to proceed to Step SB3 as indicated with an arrow "YES". If the lyrics data LD is not received, Step SB2 is repeated as indicated with an arrow "NO" to wait the reception of the data.

At Step SB3, a lyrics displaying screen is formed based on the first page data from the received lyrics data LD for all the pages to display it on the display 11 in the computer 1P.

At Step SB4, it is judged whether the start command transmitted at Step SA7 is received or not. If the start command is received, the process proceeds to Step SB5 as indicated with an arrow "YES". If the start command is not received, Step SB4 is repeated as indicated with an arrow "NO" to wait for receiving the start command.

At Step SB5, it is judged whether the current timing is a new page timing or not, for example, whether the reproduction of the music data PD corresponding to the lyrics displayed in the previous page is finished or not. If the current timing is the new page timing, the process proceeds to Step SB5 as indicated with an arrow "YES". If it is not the new page timing, the process proceeds to Step SB7 as indicated with an arrow "NO". The judgment whether it is the new page timing or not is executed by the similar way as at Step SA9.

At Step SB6, the lyrics data LD up to the next new page timing (for every page) is read, and a lyrics displaying screen for the next page is formed to display.

At Step SB7, a wipe process of the lyrics display is executed in accordance with the timing data LD, and the wipe process at this step is at least for displaying the lyrics corresponding to the current position in the music data can be visually recognized by the user. A velocity (tempo) of the wipe process is controlled on the PC side, and the wipe process is executed independently from that executed by the electronic musical instrument. Moreover, it is desirable that an initial value of the velocity (tempo) controlled on the PC side is, for example, received with the lyrics data from the electronic musical instrument before the reproduction.

At Step SB8, it is judged whether the synchronization information SI transmitted at Step SA12 is received or not. If the synchronization information SI is received, the process proceeds to Step SB9 as indicated with an arrow "YES", and synchronization of timing is established by using the received synchronization information SI. That is, the process of the wipe process controlled on the PC side is adjusted in accordance with the synchronization signal. Here, by establishing the synchronization of timing, the lyrics display on the PC side can be synchronized with the reproduction of the music data by the electronic musical instrument and with the displaying timing of the lyrics data LD. If the synchronization information SI is not received, the process proceeds to Step SB10.

At Step SB10, it is judged whether the stop command transmitted at Step SA15 is received or not. If the stop command is received, the process proceeds to Step SB11 as indicated with an arrow "YES". If the stop command is not received, the process returns to Step SB5 as indicated with an arrow "NO" to repeat the process after the Step SB5.

At Step SB11, the lyrics data LD stored in the reproduction buffer 36 is deleted, and the process proceeds to Step SB12 to finish the process on the PC side.

In the above-described examples shown in FIG. 4, all the lyrics information is extracted from the music data PD, the lyrics data LD including all the lyrics information is transmitted to the PC side at once before starting the reproduction of the music data. Also, only the synchronization information SI is transmitted from the electronic musical instrument to the PC during the reproduction. By doing this, an amount of data to be transmitted during the reproduction of the music data can be decreased.

FIG. 5 shows flow charts showing other examples of processes executed by the electronic musical instrument 1A and the computer 1P at a time that the lyrics data LD for every page is generated and transmitted one by one. Step SC1 to Step SC16 represent processes executed by the electronic musical instrument 1A (transmitting side: the automatic musical performance apparatus), and Step SD1 to Step SD12 represent processes executed by the computer 1P (receiving side: the lyrics displaying apparatus). Other conditions are the same as in the examples shown in FIG. 4.

Since the processes at Step SC1 and Step SC2 are similar to the processes at Step SA1 and Step SA2 in FIG. 4, explanation for those will be omitted.

At Step SC3, the lyrics data LD (FIG. 3) is generated by extracting the lyrics information (e.g., the lyrics event LE in FIG. 3) and its timing information (e.g., the timing data TM in FIG. 3) for one page from the music data PD selected at Step SC2, that is, from the very beginning of the music data PD to the lyrics event including the first new line command and the timing data corresponding to the lyrics data. Thereafter, the generated lyrics data LD is transmitted to the computer (PC) 1P.

At Step SC4, a lyrics displaying screen for the first page is formed based on the lyrics data LD generated at Step SC3, and for example, the lyrics displaying screen is represented on the display 11 in the electronic musical instrument 1A.

Since the processes from Step SC5 to Step SC9 are similar to the processes from Step SA6 to Step SA10 in FIG. 4, explanation for those will be omitted.

At Step SC10, the lyrics data LD (FIG. 3) is generated by extracting the lyrics information (e.g., the lyrics event LE in FIG. 3) and its timing information (e.g., the timing data TM in FIG. 3) for one page from the music data PD selected at Step SC2, that is, from just after the lyrics event including the new line command and the timing data corresponding to the lyrics data included in the lyrics data LD generated at Step SC3 to the lyrics event including the next new line command and the timing data corresponding to the lyrics data. Thereafter, the generated lyrics data LD is transmitted to the computer (PC) 1P.

Since the processes from Step SC11 to Step SC16 are similar to the processes from Step SA11 to Step SA16 in FIG. 4, explanation for those will be omitted.

Also, since the processes from Step SD1 to Step SD4 are similar to the processes from Step SB1 to Step SB4 in FIG. 4, explanation for those will be omitted.

At Step SD5, it is judged whether the lyrics data LD transmitted (for a page to be displayed in the next screen) at Step SC10 is received or not. If the lyrics data LD is received, the process proceeds to Step SD6 as indicated with an arrow "YES". If the lyrics data LD is not received, the process proceeds to Step SD7 as indicated with an arrow "NO".

At Step SD6, as same as the process at Step SD3 (or Step SB3 in FIG. 4), a lyrics displaying screen is formed based on the lyrics data LD received at Step SD5 to display on the display 11 in the computer (PC) 1P.

Since the processes from Step SD7 to Step SD12 are similar to the processes from Step SB7 to Step SB12 in FIG. 4, explanation for those will be omitted.

In the above-described examples shown in FIG. 5, the lyrics information is extracted for every page from the music data PD, the lyrics data LD including lyrics information for one page is transmitted to the PC side one by one. By doing this, time for starting the reproduction of the music data and the display of the lyrics can be shortened.

Moreover, in the above-described examples shown in FIG. 5, the extraction of the lyrics information is executed for every page one by one. However, all the lyrics information is extracted at once in advance, and the extracted lyrics information may be divided into the lyrics data LD for one page to be transmitted one by one.

As described before, according to the embodiment of the present invention, the lyrics data LD is extracted from the music data to transmit the lyrics data LD to the external lyrics displaying apparatus, and the synchronization signal can be transmitted during the reproduction of the music in accordance with the progress of the music. By that, for example, an apparatus that can transmit the lyrics data LD and the synchronization information SI to the external electronic musical apparatus based on the MIDI Standards may be acceptable, and the lyrics can be displayed at the external lyrics displaying apparatus without an expensive video-out device.

Moreover, if the transmissions of the above-described lyrics data LD and the synchronization signal are based on the MIDI Standards, a new hardware for displaying lyrics at the external electronic musical apparatus becomes unnecessary because most of the electronic musical apparatus equips an interface based on the MIDI Standards.

Also, since the lyrics data LD is displayed in accordance with the synchronization signal after receiving the lyrics data LD from the external electronic musical apparatus, the lyrics display becomes possible in cooperation with the external electronic musical apparatus.

Furthermore, although the deletion of the lyrics data LD from the reproduction buffer is executed immediately after the reproduction of one music at Step SB11 in FIG. 4 or Step SD11 in FIG. 5, the deletion may be executed at anytime after displaying the lyrics, for example, the lyrics data LD may be deleted when the lyrics data LD for the next music is transmitted, or at a time of the termination (power off) of the apparatus on the receiving side (the lyrics displaying soft). When the same music is reproduced many times, the lyrics data LD does not need to be newly transmitted by the transmitting side, the lyrics data LD stored on the lyrics displaying apparatus side may be used repeatedly. Moreover, in that case, synchronization information SI is also transmitted every time of the reproduction in accordance with the progress of the reproduction.

Also, in order to prohibit storing and copying the stored lyrics data to a designated storage medium, it is preferable that a lyrics displaying software has a protection function on the receiving apparatus side for copy right protection, or to encode the lyrics data.

Although, in the embodiment, the transmission of the lyrics data LD is started when the music is selected, it is not limited to that. For example, the transmission may be started when the reproduction of the music is started (in this case, however; a user has to wait for the lyrics to be displayed from the reproduction instruction until the display of the lyrics will be enabled), or the lyrics data LD of the stored music may be transmitted without a relationship with the selection of the music during a blank time of the automatic musical performance apparatus. Moreover, if the transmission of the lyrics is not finished when the reproduction of the music is instructed, it is desirable that the reproduction of the music is delayed until the transmission finishes.

Moreover, although the lyrics for one page is transmitted when it becomes a new page timing of the lyrics in the examples shown in FIG. 5, transmission may be started slightly early for considerable time for transmission. Also, a unit of transmission is not limited for one page, the lyrics for plural pages may be transmitted at once, or the lyrics for one page may be transmitted dividing to plural times.

Further, although the MIDI clock and the MIDI time code are mentioned as the synchronization information SI, "start", "stop", a tempo clock (F8), performance position information (a measure, a beat, a lapse clock from the beginning of the music, a lapse time from the beginning of the music) and any types of information that can establish synchronization between the transmission apparatus side and the receiving apparatus side may be used for the synchronization information SI.

Also, on the receiving apparatus side (the lyrics displaying apparatus), a background image may be selected corresponding to the music genre to display as a background of the lyrics display. The music genre may be transmitted from the electronic musical apparatus on the transmitting side to the electronic musical apparatus on the receiving side (the lyrics displaying apparatus) by including genre information in the music data, or the music genre may be decided from contents of the lyrics data LD at the electronic musical apparatus on the receiving side (the lyrics displaying apparatus).

Also, instead of the lyrics data, or in addition to the lyrics data, chord name data is stored in the music data, and it may be extracted to transfer to an external apparatus, and the chord name data may be displayed corresponding to the synchronization information received by the external apparatus. That is, the present invention can be applied not only to lyrics or chord names but also to a character (text) that is displayed along with a progress of music. In that case, text data (including lyrics and chord names) is stored in the music data in advance, extracted from the music data at once or by a certain unit, and transmitted to an external device. When the music data is reproduced, the synchronization information is transmitted as required from the electronic music apparatus to the external device, and the external device controls displaying style of characters (text) in accordance with the received text data in synchronization with the synchronization information.

Moreover, the electronic musical apparatus 1 (the electronic musical instrument 1A or the computer 1P) according to the embodiment of the present invention is not limited to a form of the electronic musical instrument or the computer, and it may be applied to a Karaoke device, a mobile communication terminal such as a cellular phone and an automatic performance piano. If it is applied to the mobile communication terminal, it is not limited to that the terminal has complete functions but also a system consisted of a terminal and a server as a whole may be realized by the terminal having one part of functions and the server having another part of functions.

Also, when the electronic musical instrument type is used, the type of the musical instrument is not limited to a keyboard instrument as explained in the embodiment of the present invention, and it may be a stringed instrument type, a wind instrument type and a percussion instrument type. Also, it is not limited to the apparatus in which the musical tone generator and the automatic musical performance device are built in one apparatus, and they may be separate devices connecting with each other by using communication means such as MIDI and various networks.

Also, in the embodiment of the present invention, the transmitting side of the lyrics data LD is the electronic musical instrument 1A, and the receiving side (the lyrics displaying apparatus) is the computer 1P. The transmitting side may be the computer 1P, and the receiving side may be the electronic musical instrument 1A.

Also, the embodiment of the present invention may be executed by a general personal computer to which a computer program corresponding to the embodiment of the present invention is installed.

In such a case, the computer programs or the like realizing the functions of the embodiment may be stored in a computer readable storage medium such as a CD-ROM and a floppy disk and supplied to users.

The present invention has been described in connection with the preferred embodiments. The invention is not limited only to the above embodiments. It is apparent that various modifications, improvements, combinations, etc. can be made by those skilled in the art.

What is claimed is:

1. A system including an electronic music apparatus and a lyrics displaying apparatus, the electronic music apparatus comprising:

an extractor that extracts lyrics data from music data for reproduction of music and comprising the lyrics data representing lyrics of the music;

a transmitter that transmits the extracted lyrics data to the lyrics displaying apparatus;

a reproducer that reproduces the music data; and a first displaying device that displays first lyrics in accordance with the extracted lyrics data while the music data is reproduced; and a first displaying device that displays first lyrics in accordance with the extracted lyrics data while the music data is reproduced;

an outputting device that outputs synchronization information for controlling display of the lyrics based on the lyrics data to the lyrics displaying apparatus during the reproduction of the music data in accordance with a progress of the reproduction of the music data; and the lyrics displaying apparatus comprising a receiver that receives the lyrics data transmitted from the transmitter and the synchronization information transmitted from the outputting device;

a memory that temporarily stores the received lyrics data;

a second display that displays second lyrics in accordance with the received lyrics data;

a controller that controls the display of the second lyrics in accordance with the received synchronization information, and wherein the display of the first lyrics by the first displaying device and the display of the second lyrics by the second displaying device are synchronized with each other in accordance with the synchronization information.

2. The electronic music apparatus according to claim 1, wherein the extractor extracts the lyrics data by a predetermined unit during the reproduction of the music data, and the transmitter transmits the extracted lyrics data by the predetermined unit.

3. The electronic music apparatus according to claim 1, wherein the extractor extracts the lyrics data all at once, and the transmitter transmits the extracted lyrics data all at once to the lyrics displaying apparatus.

4. The electronic music apparatus according to claim 1, wherein the lyrics data comprises at least text representing the lyrics of the music.

5. The electronic music apparatus according to claim 4, wherein the lyrics data further comprises timing data representing display timing of the lyrics data.

6. The electronic music apparatus according to claim 1, wherein the lyrics data and the synchronization information are transmitted based on MIDI Standards.

7. The electronic music apparatus according to claim 1, wherein the synchronization information is at least one of MIDI clock, MIDI time code, start, stop, tempo clock and performance position information.

8. The electronic music apparatus according to claim 1, wherein the music data further comprising chord data representing a chord name, the extractor further extracts the chord data from the music data, and the transmitter further transmits the extracted chord data.

9. The electronic music apparatus according to claim 1, wherein the electronic music apparatus is connected to the lyrics displaying apparatus via one of a dedicated MIDI interface, an RS-232C interface, a universal serial bus interface and an IEEE1394 interface.

10. The lyrics displaying apparatus according to claim 1, wherein the receiver receives the lyrics data by a predetermined unit during the reproduction of the music data by the lyrics displaying apparatus.

11. The lyrics displaying apparatus according to claim 1, wherein the receiver receives the lyrics data all at once.

12. The lyrics displaying apparatus according to claim 1, wherein the controller controls the display of the lyrics by the second displaying device in accordance with the received synchronization information so as to synchronize with reproduction of the music data by the lyrics displaying apparatus.

13. The lyrics displaying apparatus according to claim 1, wherein the receiver further receives chord data representing a chord name, the second displaying device further displays the chord name in accordance with the received chord data, and the controller further controls display of the chord name in accordance with the received synchronization information.

14. A system including an electronic music apparatus and a text displaying apparatus, the electronic music apparatus comprising:

an extractor that extracts text data from music data for reproduction of music and comprising the text data;

a transmitter that transmits the extracted text data to the text displaying apparatus;

a reproducer that reproduces the music data;

a first displaying device that displays first text in accordance with the extracted text data while the music data is reproduced; and an outputting device that outputs synchronization information for controlling display of the text based on the text data to the text displaying apparatus during the reproduction of the music data in accordance with a progress of the reproduction of the music data, and the text displaying apparatus comprising a receiver that receives the text data transmitted from the transmitter and the synchronization information transmitted from the outputting device;

a memory that temporarily stores the received text data;

a second display that displays second text in accordance with the received text data;

a controller that controls the display of the second text in accordance with the received synchronization information, and wherein the display of the first text by the first displaying device and the display of the second text by the second displaying device are synchronized with each other in accordance with the synchronization information.

15. The electronic music apparatus according to claim 14, wherein the text data represents lyrics or a chord name.

16. A method for displaying lyrics in a system including an electronic music apparatus and a lyrics displaying apparatus, the method comprising the steps of:

extracting lyrics data from music data for reproduction of music and comprising the lyrics data representing lyrics of the music on the electronic music apparatus;

transmitting the extracted lyrics data to the lyrics displaying apparatus from the electronic music apparatus;

reproducing the music data on the electronic music apparatus;

displaying first lyrics in accordance with the extracted lyrics data on the electronic music apparatus while the music data is reproduced;

outputting synchronization information for controlling display of the lyrics based on the lyrics data to the lyrics displaying apparatus from the electronic music apparatus during the reproduction of the music data in accordance with a progress of the reproduction of the music data;

receiving the lyrics data transmitted from the electronic music apparatus and the synchronization information transmitted from the electronic music apparatus;

temporarily storing the received lyrics data on the lyrics displaying apparatus;

displaying second lyrics in accordance with the received lyrics data on the lyrics displaying apparatus; and controlling the display of the second lyrics in accordance with the received synchronization information, and wherein the display of the first lyrics on the electronic music apparatus and the display of the second lyrics on the lyrics display apparatus are synchronized with each other in accordance with the synchronization information.

17. A method for displaying text in a system including an electronic music apparatus and a text displaying apparatus, the method comprising the steps of:

extracting text data from music data for reproduction of music and comprising the text data representing text of the music on the electronic music apparatus;

transmitting the extracted text data to to the text displaying apparatus from the electronic music apparatus;

reproducing the music data on the electronic music apparatus;

displaying first text in accordance with the extracted text data on the electronic music apparatus while the music data is reproduced;

outputting synchronization information for controlling display of the text based on the text data to the text displaying apparatus from the electronic music apparatus during the reproduction of the music data in accordance with a progress of the reproduction of the music data, receiving the text data transmitted from the electronic music apparatus and the synchronization information transmitted from the electronic music apparatus;

temporarily storing the received text data on the text displaying apparatus;

displaying second text in accordance with the received text data on the text displaying apparatus; and controlling the display of the second text in accordance with the received synchronization information, and wherein the display of the first text on the electronic music apparatus and the display of the second text on the text displaying apparatus are synchronized with each other in accordance with the synchronization information.

* * * * *

UNITED STATES PATENT AND TRADEMARK OFFICE

CERTIFICATE OF CORRECTION

PATENT NO. : 7,579,543 B2
APPLICATION NO. : 10/996404
DATED : August 25, 2009
INVENTOR(S) : Haruyama et al.

It is certified that error appears in the above-identified patent and that said Letters Patent is hereby corrected as shown below:

Title Page, Column 2, Item (57) Abstract:
"a" should be --an--
Column 11, Lines 53-55, Claim 1:
Delete duplicate paragraph
Column 14, Line 12, Claim 16:
"display" should be --displaying--
Column 14, Line 21, Claim 17
After "data" delete duplicate "to"

Signed and Sealed this

Twenty-ninth Day of December, 2009

David J. Kappos

David J. Kappos
*Director of the United States Patent and Trademark Office*